US007048518B2

(12) United States Patent
Oliveira et al.

(10) Patent No.: US 7,048,518 B2
(45) Date of Patent: May 23, 2006

(54) PUMP

(75) Inventors: Ricardo Augusto De Facci Oliveira, Caxias do Sul (BR); Fernando Augusto Becker, Porto Alegre (BR)

(73) Assignee: Eberle Equipamentos e Processos S.A., Caxias do Sul (BR)

( * ) Notice: Subject to any disclaimer, the term of this patent is extended or adjusted under 35 U.S.C. 154(b) by 276 days.

(21) Appl. No.: 10/305,385

(22) Filed: Nov. 27, 2002

(65) Prior Publication Data

US 2003/0124002 A1 Jul. 3, 2003

Related U.S. Application Data

(63) Continuation-in-part of application No. 10/050,033, filed on Jan. 17, 2002, now abandoned.

(30) Foreign Application Priority Data

Jul. 16, 2001 (BR) ..... 0103034
Sep. 20, 2002 (BR) ..... 10103034

(51) Int. Cl.
*F04B 17/00* (2006.01)
*F04B 35/04* (2006.01)

(52) U.S. Cl. ..... 417/357; 417/372; 417/423.14

(58) Field of Classification Search ..... 417/357, 417/372, 373, 366, 4, 313, 423.11, 423.14, 417/351, 356, 423.9; 415/203
See application file for complete search history.

(56) References Cited

U.S. PATENT DOCUMENTS

| | | | | | |
|---|---|---|---|---|---|
| 3,135,211 | A | * | 6/1964 | Pezzillo | 103/87 |
| 3,220,349 | A | * | 11/1965 | White | 103/87 |
| 3,836,286 | A | | 9/1974 | Malaval | 417/50 |
| 4,047,847 | A | | 9/1977 | Oikawa | 417/370 |
| 4,115,038 | A | * | 9/1978 | Litzenberg | 417/357 |
| 5,009,578 | A | * | 4/1991 | Hyland | 417/365 |
| 5,201,642 | A | | 4/1993 | Hinckley | 417/420 |
| 5,443,503 | A | | 8/1995 | Yamane | 623/3 |
| 5,555,956 | A | * | 9/1996 | Voss et al. | 184/6.16 |
| 5,700,138 | A | * | 12/1997 | Bevington | 417/366 |
| 5,890,880 | A | | 4/1999 | Lustwerk | 417/366 |
| 5,921,683 | A | * | 7/1999 | Merritt et al. | 384/106 |
| 5,997,261 | A | * | 12/1999 | Kershaw et al. | 417/366 |
| 6,010,319 | A | * | 1/2000 | Moon | 417/423.14 |
| 6,068,455 | A | * | 5/2000 | Cowans | 417/366 |
| 6,274,962 | B1 | * | 8/2001 | Kliman | 310/261 |
| 2004/0115038 | A1 | | 6/2004 | Nuesser et al. | |

FOREIGN PATENT DOCUMENTS

| | | |
|---|---|---|
| BR | PI0004206-4 | 4/2002 |
| DE | 38 22 897 | 1/1990 |
| EP | 1 398 508 | 3/2004 |
| GB | 1 372 669 | 11/1974 |
| WO | WO 02/066837 | 8/2002 |

OTHER PUBLICATIONS

Declaration and Verified Translation of priority document PI 0103034–5, filed Jul. 16, 2001.

* cited by examiner

*Primary Examiner*—Justine R. Yu

(57) ABSTRACT

The present invention comprises a pump (10, 110) having a casing (14, 114) with at least one first hermetically sealed chamber (19, 119) and at least one second chamber (17, 117) adjacent to said first chamber, defining a passageway (18, 118) for fluids and having an inlet (15, 115) and an outlet (16, 116) for the fluids. The stator (12, 112) is provided in this first chamber (19, 119). In addition, a rotor-turbine assembly (11, 111) is induced by the stator (12, 112) to drive a fluid from the inlet (15, 115) to the outlet (16, 116), the rotor and the turbine being integral and wholly located in the second chamber (17, 117). In a preferred embodiment, a fluid course between the opening of outlet (115) and fluid passage (118), in portion (119*a*) of first chamber (119), is provided with filtration zone (120) suitable for filtration of a fluid to be impelled by the pump.

32 Claims, 5 Drawing Sheets

PUMP

CROSS REFERENCE TO RELATED APPLICATION(S)

This is a continuation-in-part of U.S. patent application Ser. No. 10/050,033 filed Jan. 17, 2002 and now abandoned, and which is incorporated herein by reference.

FIELD OF THE INVENTION

The present invention relates to a pump, more specifically, a hydraulic one.

BACKGROUND DESCRIPTION

At present, there are different types of electromechanical pumps used for driving fluids, generally constituted of a chamber containing the electromagnetic part, basically comprising the stator and the rotor armature, as well as another chamber with a hydraulic part, basically formed of the hydraulic turbine that drives the liquid. However, the electromagnetic and hydraulic chambers need to be insulated from each other so as to prevent the liquid from reaching the stator and the rotor, causing short-circuits and even irreparable damage. Thus, in order to achieve this insulation of the chambers and transmission of rotation movement from the rotor to the hydraulic turbine, several mechanical apparatus are required, such as an axle, roller bearings, bearing journals, cooling systems, hydraulic seals, among others.

The roller bearing journals, for instance, have the function of supporting the rotor axle, on which the rotor cage is mounted, so that, when the latter is induced by magnetic forces from the stator, the rotor turns, assisted by these bearings. Of course, the bearings are lubricated with oil or grease so as to decrease friction and wear between the parts in contact.

One end of the rotor axle is connected to the hydraulic turbine, formed of blades, which, upon induction of the rotor, begins a rotational movement driving the liquid to be pumped.

To prevent the temperature of both the stator and the rotor from reaching undesired levels during their functioning, external cooling systems are used, usually constituted of ventilators. Such cooling systems generally comprise propellers coupled to the end of the rotor axle, outside the pump and opposed to the hydraulic pump, which, taking advantage of the rotation of the rotor, turns to cool both the stator and the rotor.

The pumps of the prior art depend upon the perfect functioning of the mechanical seals to prevent the liquid from passing from the hydraulic chamber into the electromagnetic chamber. As already mentioned, this undesirable contact of the liquid with the stator and rotor may cause short-circuits, as well as a decrease in the lubrication of the bearings, resulting in possible seizure of the rotor.

Therefore, one can verify the fact that the prior art pumps have hydraulically insulated chambers, wherein an induced, rotor located in a hermetically sealed chamber, transmits rotation by means of its axle to a hydraulic turbine located in another liquid-passage chamber, making it necessary for these pumps to have a number of sealing mechanisms to prevent the occurrence of damage that might even render them useless. In addition, with use and the consequent wear of these mechanisms, such pumps lose their mechanical efficiency. Thus, this combination has the drawback of entailing high costs, because it involves expensive parts, a complex manufacturing process and constant maintenance to keep such pumps functioning.

SUMMARY OF THE INVENTION

A preferred embodiment of the present invention simplifies the composition of a traditional pump by eliminating sealings, such as mechanical seals or gaskets, as well as roller bearings, axles and external cooling systems, such as ventilators, thereby reducing the chance of the pump being damaged. This new pump motor further provides cooling of the stator-rotor assembly by circulating the pumped fluid itself, as described in Brazilian Patent Application No. PI 0004206-4, published on Apr. 16, 2002, which is incorporated herein by reference.

In addition, a preferred embodiment of the invention also provides a new pump that is more compact than the present ones, easy to manufacture and assemble, by virtue of its smaller number of components, thus resulting in better automation and cost reduction.

Another feature of a preferred embodiment of the present invention is to provide a pump design that is more efficient, that is, presenting lower energy loss.

In addition, the invention aims at providing a safer, more protected and corrosion proof pump motor, enabling immersion and installation in environments that are aggressive and without cooling.

A further feature of a preferred embodiment of the present invention is to provide a pump with a very low noise level and lubrication provided by the circulating fluid itself.

The present invention preferably comprises a pump that has a casing, having at least one first hermetically sealed chamber and at least one second chamber adjacent to said first chamber, provided with a fluid passage and having an inlet and an outlet for fluids. Said chambers are separated by means of walls, preferably made of injected polymer.

The pump further comprises a stator located in the first chamber. In a preferred embodiment, the stator is in a position adjacent to the walls that separate the first chamber from the second, so that the fluid circulating through the second chamber will cool it by heat transmission.

An integral rotor-turbine assembly, preferably wholly located in the second chamber, is provided, and at least a portion of said assembly is positioned concentrically in relation to the stator. This assembly is induced by the stator to drive a fluid from the inlet to the outlet. When the pump is functioning, at least a fluid film is maintained around the assembly, in order to bring about high performance/accurate rotation with minimum friction and without any need for journals. In other words, when the assembly is induced by the stator, the fluid film works as a bearing to support the assembly. The space between said assembly and the stator, called a gap, is substantially filled with said walls of the first and second chambers, including, furthermore, the fluid film circulating between them.

A metallic component, called the rotor cage, preferably composed of iron and aluminium, capable of being induced by the stator, is provided inside the hermetically sealed assembly. In the preferred embodiment, such an assembly is made from polymeric material and is additionally bored through to provide a passage for the turbine inside the rotor. In possible embodiments of the present invention, the turbine of said assembly is composed of turbine blades to centrifuge the fluids. In this way, upon functioning of a possible embodiment of the pump, the fluid, after passing through the inlet of the second chamber, goes into the rotor-turbine assembly, passes through the internal passageway and, after reaching the turbine blades, is driven towards the outlet.

However, a portion of the fluid, instead of coming out directly through the outlet, circulates around the first chamber and cools the stator by heat transmission. In this way, the need for an external cooling system is eliminated, since the heat exchange between the circulating fluid and the driving assembly will result in cooling this assembly, so that its temperature will always preferably remain at desirable levels for its good functioning.

In addition, the circulating fluid is also used as a lubricant. A film of circulating fluid will pass between the walls of the second chamber and the rotor-turbine assembly, allowing the latter to make a floating rotary movement within the second chamber by virtue of the inducing forces.

In a preferred embodiment, the first chamber provides a circular path with a filtration zone, whereby the fluid, upon entry via the pump's fluid inlet, circulates through a portion of the first chamber, passes through a filter and proceeds to a turbine assembly, after which it is propelled to the fluid outlet, as well as allowing part of the fluid to enter a portion of the second chamber, providing cooling of the pump motor. Additionally, the present pump further incorporates front and rear covers for the principal housing.

In view of the foregoing, the pump of the present invention provides a simpler configuration with less expensive manufacture, since it is basically composed of an induction means and a movement-transmission means similar to those of the prior art, such as stators and rotors, which eliminate the use of a ventilator, as well as roller bearings, axles and mechanical seals.

BRIEF DESCRIPTION OF THE DRAWINGS

The present invention will now be described in greater detail with reference to the drawings.

DETAILED DESCRIPTION OF THE FIGURES

Figure 1:
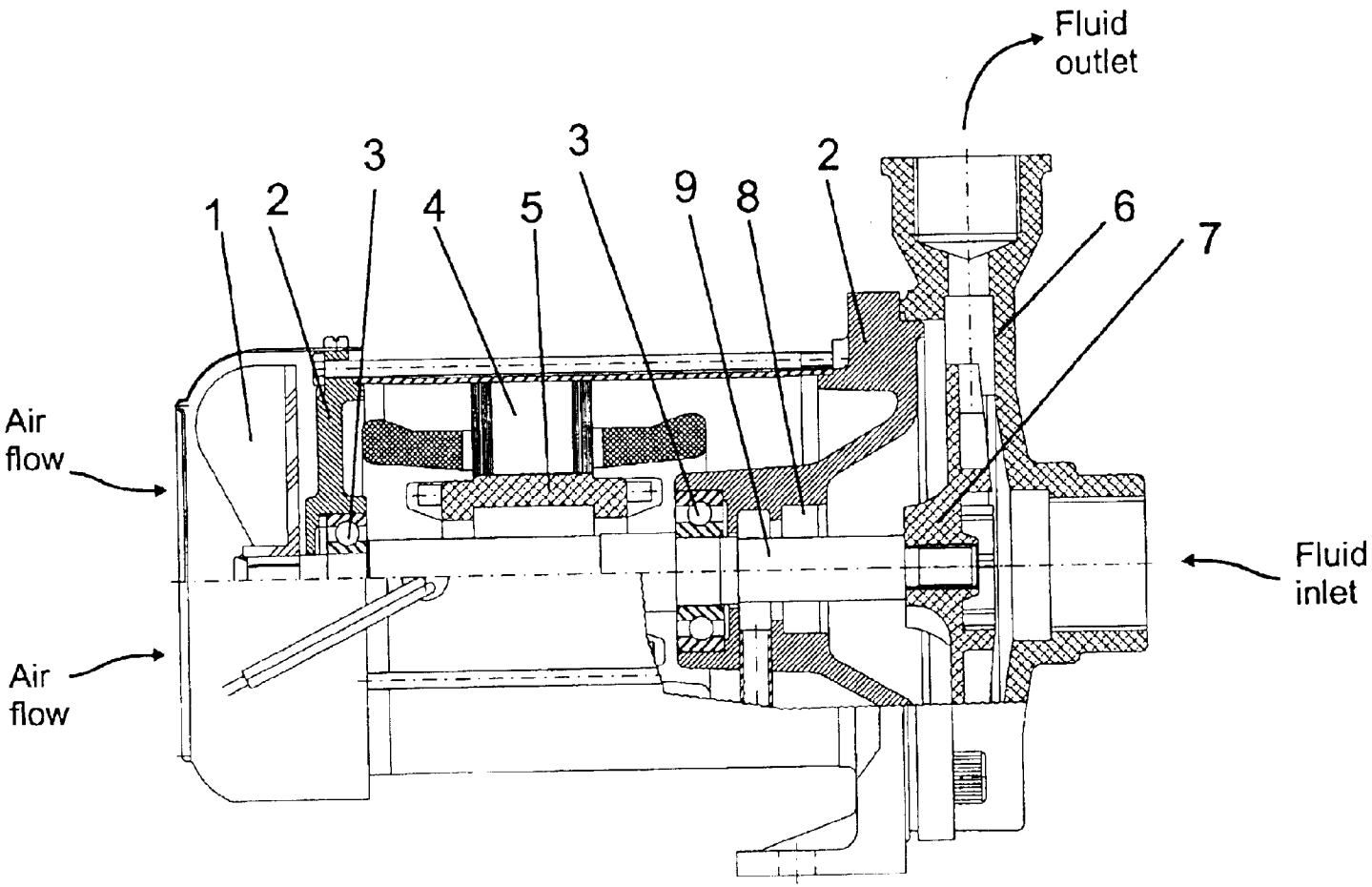
FIG. 1 Prior Art
FIG. 1—is a cross-section side view of a typical pump motor of the prior art.

FIG. 1 shows a present-day pump, encountered in the prior art, comprising a coiled stator 4, a rotor 5 and roller bearings 3, which support the axle 9 on which the cage of said rotor 5 is mounted. The axle 9 will be responsible for transmitting driving force from the rotor 5 by means of induction of the magnetic field of the stator 4. One can also note in this figure the existence of a ventilator 1, which is responsible for cooling the stator-rotor assembly, and of covers 2 located on both sides of the rotor 5, which support said roller bearings.

In addition, in order to achieve a good functioning of this type of pump motor, the rotor 5 has to be perfectly centered with respect to the stator 4, so as to avoid contact between their magnetic iron. In the pump motor represented in FIG. 1, this space between the rotor 5 and the stator 4, called a gap, is filled with air.

FIG. 1 further illustrates mechanical seals 8, which are widely used in the pump motors of the prior art, to guarantee insulation and separation between the electric part and the hydraulic part of the pump motor, the hydraulic part being constituted of the turbine 7 and the volute 6.

Figure 2:
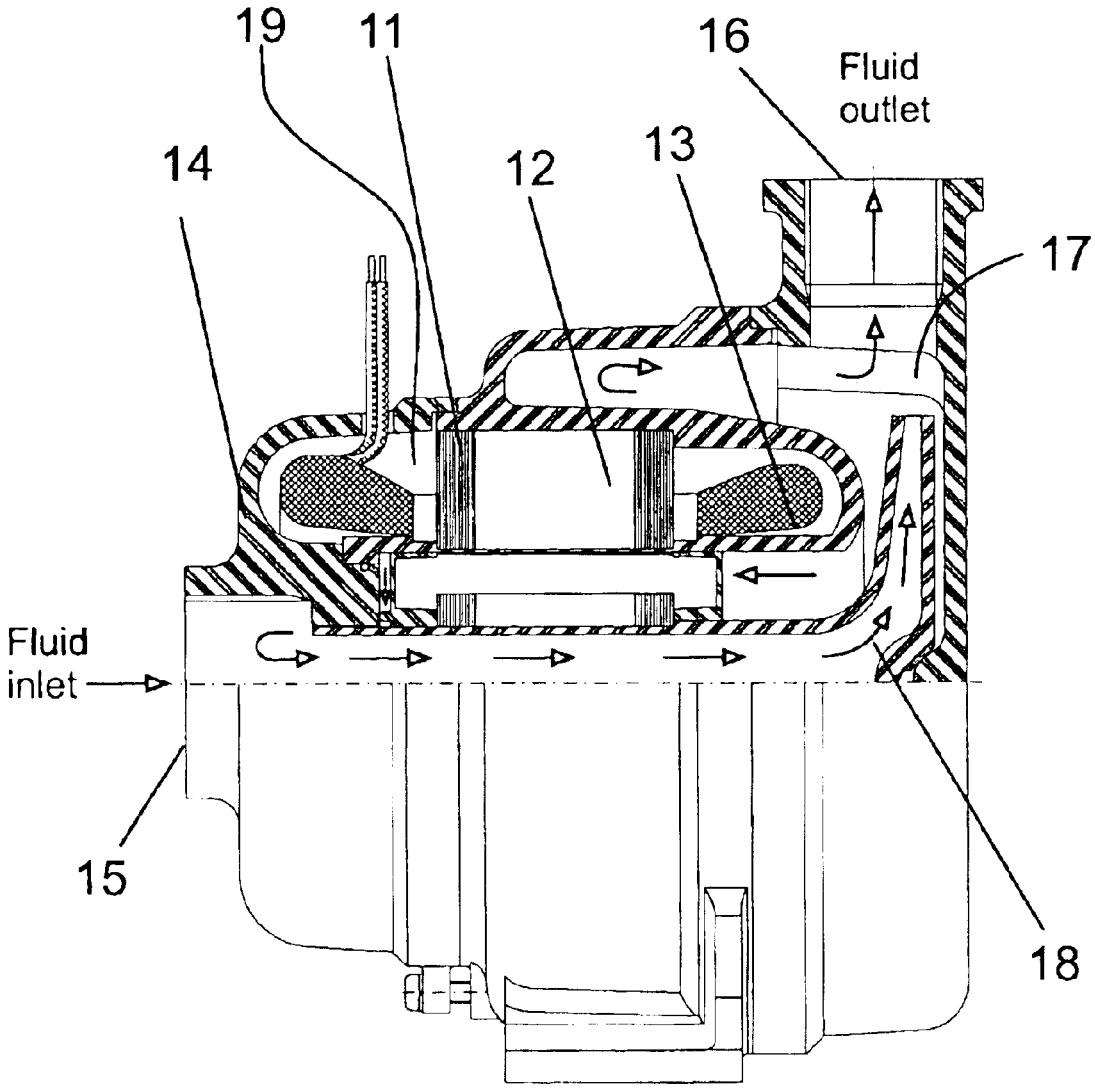
FIG. 2—is a cross-section side view of a first embodiment of the present invention.

FIG. 2, on the other hand, illustrates a preferred embodiment of the present invention, in which some of the elements shown in FIG. 1 are absent. This embodiment illustrates a pump 10 comprising a casing 14 having a first hermetically sealed chamber 19 and a second internal chamber 17 with at least one inlet 15 and one outlet 16 defining the passageway 18 between said inlet and outlet. The casing 14 may be made from a polymeric material or any other type of material suitable for the specified conditions, including bad weather.

An integral rotor-turbine assembly 11 is located in the chamber 17 to drive the fluids that pass through said chamber. This assembly is made from a polymeric material and, in addition, is bored through to define a passageway for the turbine inside the rotor. In this embodiment, the turbine of said assembly is composed of blades for centrifuging the fluids. In this way, when in operation, the fluid, after passing through the inlet 15 of the chamber 17, goes into the rotor-turbine assembly 11, passes through the internal passageway, and, after reaching the turbine blades, is driven toward the outlet 16.

The casing 14 also has a first chamber 19, hermetically sealed from the fluids that circulate through the second chamber 17. Both the external walls of the casing and the walls that separate the second chamber 17 from the first chamber 19 are formed of injectable polymeric material. In addition, the stator 12, which may be any one of those known from the prior art, is installed in this first chamber 19 to induce, by means of a magnetic field, the driving of the rotor-turbine assembly 11, located in the second chamber 17 of fluid circulation.

This embodiment of the pump of the present invention also has its second chamber 17 defining passageways other than that going from the inlet to the outlet, so that a portion of the fluids will circulate through this chamber. Such passageways in this embodiment cause the fluid to circulate around the first chamber 19, cooling the stator 12 located therein by heat transmission.

In addition, a small portion of the fluid that enters inlet 15 and circulates through the second chamber 17 passes through the communication means 13 between one of the walls of the second chamber 17 and the rotor-turbine assembly 11, creating a constant fluid film, which enables this assembly to turn freely submerged in the liquid, without having any contact with the walls of the second chamber 17 while the pump is functioning. In this way, when the assembly is induced by the stator 12, the fluid film works as a bearing to support the assembly 11 and, at the same time, as a lubricant that virtually eliminates friction between the walls of the second chamber and of the assembly 11, further resulting in a very low noise level. Although the assembly 11 is submerged in the liquid, without contact with the walls of the second chamber 17, the magnetic field created by the stator 12 maintains the former in a balanced position around its axle, so that, upon rotational movement, the magnetic forces prevent the assembly from contacting the walls of the second chamber 17.

In view of the foregoing, since the second chamber 17 has passageways that enable the liquid to circulate through it, a reduction in noise level is achieved, and this also eliminates the need for industrial lubricants and external cooling systems. Since, in a preferred embodiment of the pump, the pump is basically composed of an injectable polymeric material and there is a decrease in the number of components (i.e. does not include seals) in comparison with those of the prior art, it becomes simpler and less expensive to assemble. In addition, the energy losses are minimized by the low friction between the rotor-turbine assembly 11 and the walls of the second chamber 17.

Another aspect of the present invention is that the space between the stator 4 and the rotor 5 of the pumps of the prior art, the so-called gaps, are filled with air. In the present invention, on the other hand, in addition to the liquid layer 13, there is the polymeric wall of both the second chamber 17 and the rotor-turbine assembly 11, providing accurate centering of the magnetic materials of the stator 12 and the assembly 11, as well as a better balanced position of the latter around its axle, so that, upon rotation, contact with the walls of the second chamber 17 will be avoided.

In addition, the present invention also provides a non-corrosive pump, since only the surface covered with polymer will have contact with the fluid. Therefore, the latter may be aggressive without causing any damage to the pump motor. In addition, since the liquid itself is used as a coolant, the pump of the present invention may be installed in environments without ventilation or even submerged.

Figure 3:
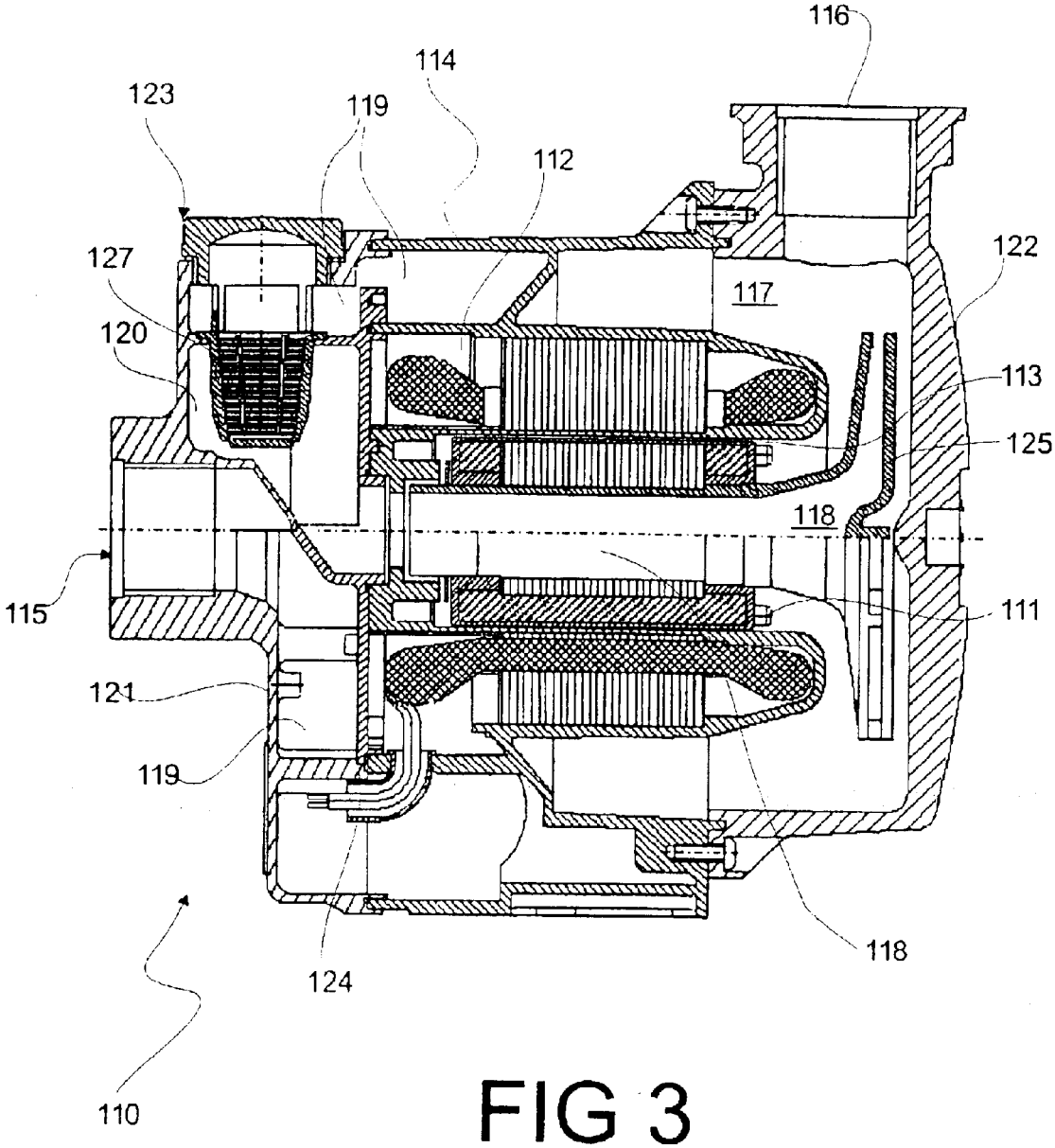
FIG. 3—is a side cross-section view of a second embodiment of the present invention.

FIG. 3 illustrates a second preferred embodiment of the present invention, where one can observe the absence of some components shown in FIG. 1, the latter representing the state of the art in pumps. This embodiment illustrates pump 110 comprising housing 114, its first chamber 119 impervious to liquids, second chamber 117 defining a fluid path, and filtration zone 120 positioned in the outlet from chamber 119 and directed towards the path between the inlet and outlet of passage 118, this providing communication for the fluid between inlet 115 and outlet 116. Housing 114 may be made of polymeric material or of any other type suitable to cope even with adverse conditions, as determined.

Furthermore, this pump consists of covers, both frontal 121 and rear 122 for housing 114, these allowing easy access to the pump mechanism for eventual maintenance and/or part replacement operations.

Thus, besides all of the advantages already set forth and indicated in the first embodiment in FIG. 2, this second embodiment provides a new technical effect by the provision of chamber 119 and filter 120. Such a new technical effect lies in the filtration of the fluid in utilizations that require pumping of a fluid that is already treated, as well as in obtaining enhanced cooling by heat exchange produced by the proximity of chambers 119 and 117, through which the fluid circulates, with the stator assembly of the pump.

Figure 4:
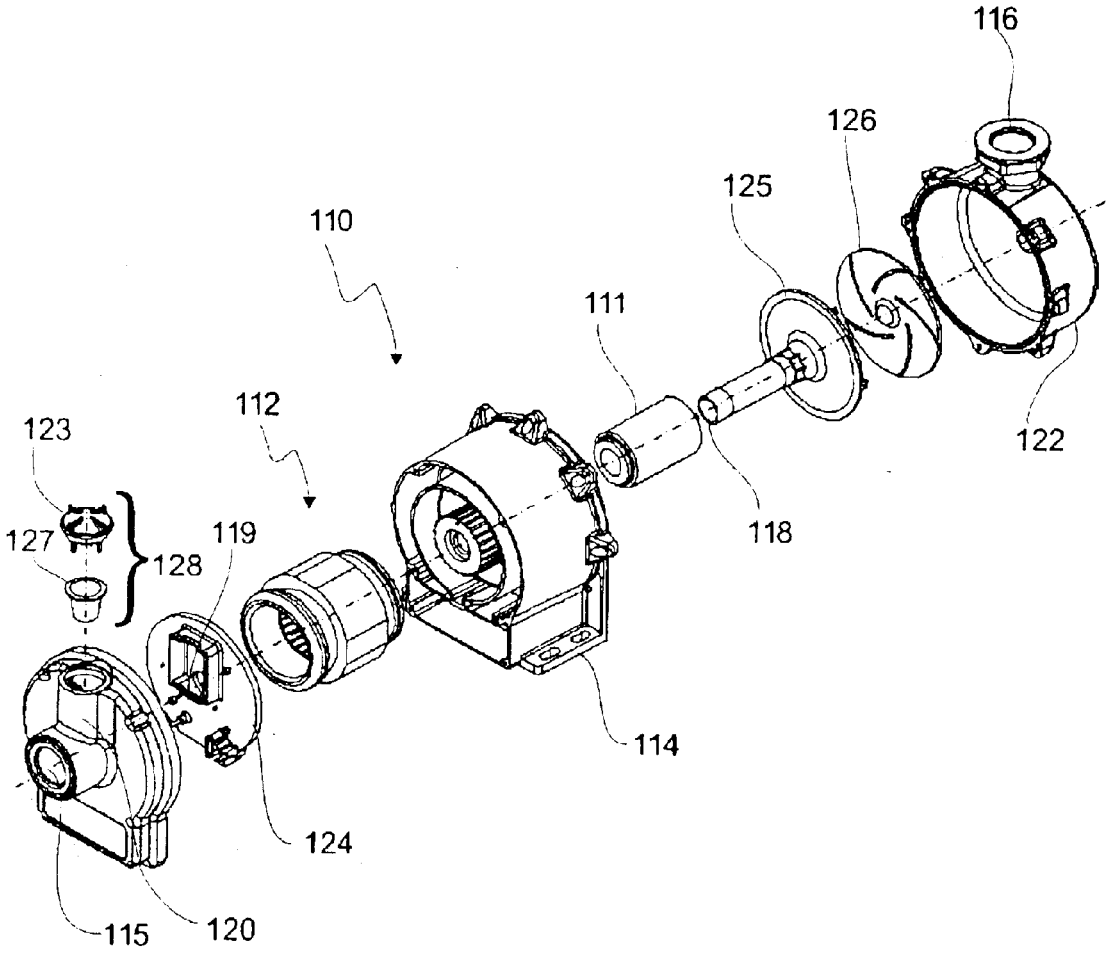
FIG. 4—is an exploded perspective view of the pump depicted in FIG. 3, allowing a clearer visualization of its components.

In order to facilitate understanding of the matter defined in this application, reference is also made to FIG. 4, which shows an exploded perspective view of the pump. As may be observed, pump 110 possesses cover 121, in which the referred filtration zone 120 is located, the latter housing removable filter assembly 128. This filter assembly 128 comprises filter cover 123 and filter element 127. Wall 124, enclosing cover 121, defines portion 119*a* (FIG. 5) of first chamber 119 in conjunction with housing 114. The stator assembly is represented by reference 112. Inside principal housing 114, the separating walls for stator assembly 112 are illustrated. A rotor, as described in FIG. 2, is also shown in the referred FIG. 3 with reference 111. Said rotor 111 is integrally incorporated with turbine 125, these being separated in this figure in order to facilitate visualization of the whole assembly. Passage 118, mentioned previously, is also depicted in this figure, inside the turbine pipe 125. It also shows disc 126 with the turbine blades, responsible for impulsion of the fluid, for instance water, towards fluid outlet 116, as well as the inside of second chamber 117. Finally, cover 122, responsible for closing the principal housing, is shown.

Figure 5:
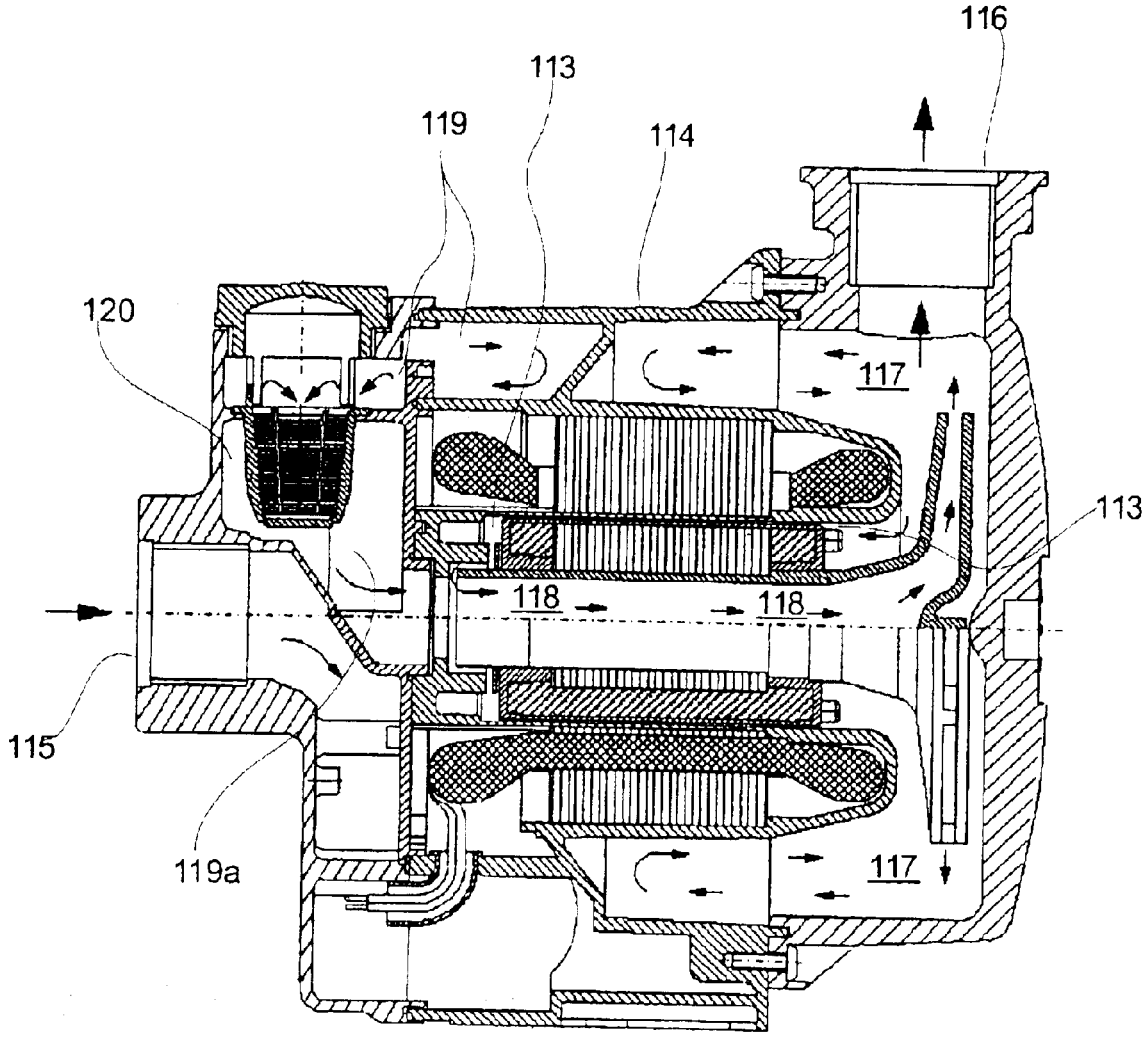
FIG. 5—is a side cross-section view, similar to that in FIG. 1, in which the course of the fluid inside the pump is shown in accordance with the embodiment indicated in FIG. 3.

Also presented for merely illustrative purposes, FIG. 5 shows the course of the fluid inside pump 110 in accordance with the second preferred embodiment of the invention, this course being represented by arrows. Upon entry to the pump via inlet 115, the fluid circulates in portion 119, providing initial cooling for the motor, passes through filtration zone 120 and then portion 119*a* towards passage 118, inside the rotor and turbine assembly. By the rotation action of the latter assembly, the fluid is propelled into second chamber 117, after which it goes to pump outlet 116. Part of the fluid propelled by the rotor-turbine assembly circulates in second chamber 117, producing a second cooling action for the motor. This fluid also runs along passage 113, forming a film between the stator and the rotor so as to cool the gap region of the motor, and, especially to avoid friction and noise generated by the rotation of the rotor. The fluid that runs along referred passage 113 is then returned to passage 118, to be propelled once more by the rotor-turbine assembly in chamber 117.

The Paris Convention Priority Applications—Brazilian Patent Application Nos. PI0103034-5 filed Jul. 16, 2001 and C1 0103034-5 filed Sep. 16, 2002 are herein incorporated by reference in their entirety.

Having described an example of preferred embodiments of the invention, it should be understood that the scope of the present invention embraces other possible variations, being limited only by the contents of the accompanying claims.

What is claimed is:

1. A pump comprising:

a casing having at least one first hermetically sealed chamber, and at least one second chamber adjacent to said first chamber, defining a passageway for fluids and having an inlet and an outlet for the fluids, the first and second chambers being separated from each other by walls;

a stator located in said first chamber;

a rotor-turbine assembly with rotor and turbine, and being capable of being induced by the stator to drive a fluid from the inlet to the outlet, at least a portion of said assembly being positioned concentrically with respect to the stator, wherein the rotor and the turbine are integral and are wholly located in the second chamber, so that, when in operation, a film of fluid will be maintained around said assembly to provide a support therefor, and wherein said rotor-turbine assembly is bored through, defining an internal fluid passageway;

wherein said integral rotor-turbine assembly is supported in said pump bearing free.

2. The pump according to claim 1, wherein said walls of the first and second chambers are made of injectable polymer.

3. The pump according to claim 1, wherein said rotor-turbine assembly is of a polymeric material, having a metallic component inside, which is capable of being induced by the stator.

4. The pump according to claim 3, wherein said metallic component is composed of iron and aluminum.

5. The pump according to claim 1, wherein said stator is located in a position adjacent to the walls that separate said first chamber from the said second, so that the circulating fluid can cool said stator by heat transmission.

6. The pump according to claim 1, wherein the turbine of said assembly is composed of blades for centrifuging the fluids.

7. The pump according to claim 1, wherein the space between said assembly and the stator is substantially filled up by walls of the first and the second chambers.

8. The pump in accordance with claim 1, further comprising a filter assembly positioned, relative to fluid flow, downstream of an opening of the inlet and upstream of a fluid passageway section defining the film of fluid maintained around said rotor-turbine assembly.

9. The pump in accordance with claim 8, in which the filtration assembly comprises a replaceable filter element and cover.

10. The pump in accordance with claim 8, in which the second chamber is arranged such that the opening of the inlet is coaxial with a hollow interior in the rotor-turbine assembly and establishes a course for the fluid, extending initially downward and then extending to an upper portion of said second chamber, where it reaches said filter assembly, the course of the fluid proceeding beyond said filter assembly, being via an intermediate chamber, and then on to a passage that constitutes the hollow interior of the rotor-turbine assembly.

11. The pump as recited in claim 1, said fluid passageway also includes an outlet stator cooling passageway section which extends into cooling contact with the second wall portion of said first chamber and is separated from the inlet stator cooling passageway section by a separation wall of said casing.

12. A pump, comprising:

a casing having a first chamber and a second chamber;

a stator received in said first chamber;

a rotor assembly received by said second chamber and positioned relative to said stator so as to be induced into rotation by the stator to drive fluid received by said pump, and said second chamber defining a fluid passageway for passage of the fluid received by said pump from an inlet of said pump to an outlet of said pump, and said fluid passageway including a fluid film bearing support fluid passageway section which positions fluid between said rotor assembly and a wall region defining said second chamber, and said first chamber sealing off said stator from fluid contact with fluid traveling in said fluid passageway, and wherein said rotor assembly includes a turbine assembly with turbine shaft and a turbine blade, and said turbine assembly being in common rotation engagement with said rotor, and said fluid passageway includes a through passageway section provided in said turbine shaft;

wherein said rotor assembly is supported in said pump bearing free.

13. The pump as recited in claim 12 wherein said fluid passageway includes a recycling fluid passageway portion which directs fluid having passed through said turbine shaft and said fluid film bearing support fluid passageway section back into fluid communication with fluid traveling in said through passageway section.

14. The pump as recited in claim 12 wherein said wall region of said second chamber is formed of a polymeric material and is positioned adjacent to said stator.

15. The pump as recited in claim 14 wherein said rotor assembly includes a polymeric wall section that is positioned between said rotor and said fluid film bearing support fluid passageway section.

16. A pump, comprising:

a casing having a first chamber and a second chamber;

a stator received in said first chamber;

a rotor assembly received by said second chamber and positioned relative to said stator so as to be induced into rotation by the stator to drive fluid received by said pump, and said second chamber defining a fluid passageway for passage of the fluid received by said pump from an inlet of said pump to an outlet of said pump, and said fluid passageway including a fluid film bearing support fluid passageway section which positions fluid between said rotor assembly and a wall region defining said second chamber, and said first chamber sealing off said stator from fluid contact with fluid traveling in said fluid passageway, and wherein said wall region of said second chamber also defines a first wall portion of said first chamber and said first chamber also includes a second wall portion positioned to an opposite side of said stator than said first wall portion, and said fluid passageway includes an inlet stator cooling passageway section and an outlet stator cooling passageway section which extend into cooling contact with the second wall portion of said first chamber and are separated by a separation wall of said casing.

17. A pump, comprising:

a casing having a first chamber and a second chamber;

a stator received in said first chamber;

a rotor assembly received by said second chamber and positioned relative to said stator so as to be induced into rotation by the stator to drive fluid received by said pump, and said second chamber defining a fluid passageway for passage of the fluid received by said pump from an inlet of said pump to an outlet of said pump, and said fluid passageway including a fluid film bearing support fluid passageway section which positions fluid between said rotor assembly and a wall region defining said second chamber, and said first chamber sealing off said stator from fluid contact with fluid traveling in said fluid passageway, and wherein said rotor assembly includes an annular rotor with a central passage through which a through passageway section of said fluid passageway axially extends, and said pump further comprising a filter assembly positioned in the fluid passageway downstream of the pump inlet and upstream of the through passageway section relative to fluid flow through said pump.

18. A pump, comprising:

a casing having a first chamber and a second chamber;

a stator received in said first chamber;

an integral rotor-turbine assembly received by said second chamber and positioned concentrically relative to said stator so as to be induced into rotation by the stator to drive fluid received by said pump, and said second chamber defining a fluid passageway for passage of the fluid received by said pump from an inlet to an outlet of said pump;

said integral rotor-turbine assembly having a through bore defining an internal passageway where the fluid received by said pump enters to be propelled to the outlet of said pump;

said fluid passageway defined by the second chamber including a fluid film bearing support section between said integral rotor-turbine assembly and a wall region defining said second chamber, thereby allowing a re-circulation of a portion of the fluid leaving the rotor-turbine assembly through said fluid film bearing support section to said internal passageway;

said wall region of said second chamber also defining a first wall portion of said first chamber and said first chamber also including a second wall portion positioned to an opposite side of said stator than said first wall portion, and said fluid passageway includes an outlet stator cooling passageway section which extends into cooling contact with the second wall portion of said first chamber, thereby cooling said stator.

19. The pump as recited in claim 18 wherein said integral rotor-turbine assembly includes a turbine blade.

20. The pump as recited in claim 18 wherein said wall region is formed of a polymeric material.

21. The pump as recited in claim 20 wherein said integral rotor-turbine assembly includes a polymeric wall section that is positioned between said assembly and said fluid film bearing support fluid passageway section.

22. The pump as recited in claim 21, wherein said integral rotor-turbine assembly has a metallic component inside, which is capable of being induced by the stator.

23. The pump as recited in claim 22, wherein said metallic component is composed of iron and aluminum.

24. The pump as recited in claim 18 further comprising a filter assembly positioned in the fluid passageway downstream of the pump inlet and upstream of the internal passageway.

25. The pump as recited in claim 18, said fluid passageway also includes an inlet stator cooling passageway section which extend into cooling contact with the second wall portion of said first chamber and is separated from the outlet stator cooling passageway section by a separation wall of said casing.

26. The pump as recited in claim 18, wherein said integral rotor-turbine assembly is bearing free.

27. A pump, comprising:

a casing having a first chamber and a second chamber;

a stator received in said first chamber;

an integral rotor-turbine assembly received by said second chamber and positioned concentrically relative to said stator so as to be induced into rotation by the stator to drive fluid received by said pump, and said second chamber defining a fluid passageway for passage of the fluid received by said pump from an inlet to an outlet of said pump;

said integral rotor-turbine assembly being bored through, defining an internal passageway where the fluid received by the pump enters to be propelled to said outlet of the pump;

said fluid passageway defined by the second chamber including a fluid film bearing support section between said integral rotor-turbine assembly and a wall region defining said second chamber, thereby allowing a re-circulation of a portion of the fluid leaving the rotor-turbine assembly through said fluid film bearing support section to said internal passageway;

said wall region of said second chamber also defines a first wall portion of said first chamber and said first chamber also includes a second wall portion positioned to an opposite side of said stator than said first wall portion, and said fluid passageway includes an inlet stator cooling passageway section which extends into cooling contact with the second wall portion of said first chamber, thereby cooling said stator.

28. A pump comprising:

a casing having at least one first hermetically sealed chamber, and at least one second chamber adjacent to said first chamber, defining a passageway for fluids and having an inlet and an outlet for the fluids, the first and second chambers being separated from each other by walls;

a stator located in said first chamber;

a rotor-turbine assembly with rotor and turbine, and being capable of being induced by the stator to drive a fluid from the inlet to the outlet, at least a portion of said assembly being positioned concentrically with respect to the stator, wherein the rotor and the turbine are integral and are wholly located in the second chamber, so that, when in operation, a film of fluid will be maintained around said assembly to provide a support therefor, and wherein said rotor-turbine assembly is bored through, defining an internal fluid passageway;

said fluid passageway also includes an outlet stator cooling passageway section which extends into cooling contact with the second wall portion of said first chamber and is separated from the inlet stator cooling passageway section by a separation wall of said casing.

29. A pump comprising:

a casing having at least one first hermetically sealed chamber, and at least one second chamber adjacent to said first chamber, defining a passageway for fluids and having an inlet and an outlet for the fluids, the first and second chambers being separated from each other by walls;

a stator located in said first chamber, a rotor-turbine assembly with rotor and turbine, and being capable of being induced by the stator to drive a fluid from the inlet to the outlet, at least a portion of said assembly being positioned concentrically with respect to the stator, wherein the rotor and the turbine are integral and are wholly located in the second chamber, so that, when in operation, a film of fluid will be maintained around said assembly to provide a support therefor, and wherein said rotor-turbine assembly is bored through, defining an internal fluid passageway;

a filter assembly positioned, relative to fluid flow, downstream of an opening of the inlet and upstream of a fluid passageway section defining the film of fluid maintained around said rotor-turbine assembly.

30. The pump in accordance with claim 29, in which the filtration assembly comprises a replaceable filter element and cover.

31. The pump in accordance with claim 29, in which the second chamber is arranged such that the opening of the inlet is coaxial with a hollow interior in the rotor-turbine assembly and establishes a course for the fluid, extending initially downward and then extending to an upper portion of said second chamber, where it reaches said filter assembly, the course of the fluid proceeding beyond said filter assembly, being via an intermediate chamber, and then on to a passage that constitutes the hollow interior of the rotor-turbine assembly.

32. A pump, comprising:

a casing having a first chamber and a second chamber;

a stator received in said first chamber;

a rotor assembly received by said second chamber and positioned relative to said stator so as to be induced into rotation by the stator to drive fluid received by said pump, and said second chamber defining a fluid passageway for passage of the fluid received by said pump from an inlet of said pump to an outlet of said pump, and said fluid passageway including a fluid film bearing support fluid passageway section which positions fluid between said rotor assembly and a wail region defining said second chamber, and said first chamber sealing off said stator from fluid contact with fluid traveling in said fluid passageway, and wherein said rotor assembly includes a turbine assembly with turbine shaft and a turbine blade, and said turbine assembly being in common rotation engagement with said rotor, and said fluid passageway includes a through passageway section provided in said turbine shaft;

wherein said fluid passageway includes a recycling fluid passageway portion which directs fluid having passed through said turbine shaft and said fluid film bearing support fluid passageway section back into fluid communication with fluid traveling in said through passageway section.

* * * * *